US005192375A

United States Patent [19]

Sawa et al.

[11] Patent Number: 5,192,375

[45] Date of Patent: * Mar. 9, 1993

[54] FE-BASED SOFT MAGNETIC ALLOY

[75] Inventors: Takao Sawa; Masami Okamura, both of Yokohama; Yumiko Takahashi, Koshigaya, all of Japan

[73] Assignee: Kabushiki Kaisha Toshiba, Kawasaki, Japan

[ * ] Notice: The portion of the term of this patent subsequent to May 28, 2008 has been disclaimed.

[21] Appl. No.: 675,057

[22] Filed: Mar. 26, 1991

Related U.S. Application Data

[60] Continuation-in-part of Ser. No. 661,607, Feb. 28, 1991, abandoned, which is a division of Ser. No. 454,019, Dec. 20, 1989, Pat. No. 5,019,190.

[30] Foreign Application Priority Data

Dec. 20, 1988 [JP] Japan ..... 63-319417

[51] Int. Cl.[5] ..... H01F 1/04

[52] U.S. Cl. ..... 148/306; 148/302; 148/303; 148/308; 148/310; 148/311; 420/83; 420/89; 336/229

[58] Field of Search ..... 148/301, 302, 303, 305, 148/306, 307, 308, 310, 311, 403, 304; 420/83, 89; 336/229

[56] References Cited

U.S. PATENT DOCUMENTS 4,881,989 11/1989 Yoshizawa et al. ..... 148/302

5,019,190 5/1991 Sawa et al. ..... 148/306

*Primary Examiner*—John P. Sheehan

*Attorney, Agent, or Firm*—Oblon, Spivak, McClelland, Maier & Neustadt

[57] ABSTRACT

An Fe-based soft magnetic alloy essentially consisting of an Fe-based alloy including fine crystal grains used for such as a magnetic core. An average size of the fine crystal grains is controlled to 300Å or less. Each of the fine crystal grains is composed of a body-centered cubic phase at least partially including a super lattice. This alloy has a high saturation flux density and excellent soft magnetic characteristics such as a low iron loss and a high magnetic permeability. This alloy is suitable as a core material for various kinds of choke coils.

6 Claims, 5 Drawing Sheets

FE-BASED SOFT MAGNETIC ALLOY

The present application is a continuation-in-part of Application Ser. No. 07/661,607, filed on Feb. 28, 1991 now abandoned, which is a divisional of application Ser. No. 07/454,019, filed Dec. 20, 1989, now U.S. Pat. No. 5,019,190.

BACKGROUND OF INVENTION

This invention relates to an Fe-based sort magnetic alloy utilized particularly suitable for producing such as a magnetic core.

Conventionally, crystalline materials such as Permalloy and Ferrite have been used as a magnetic core material utilized for such as a switching regulator operated in a high frequency range.

However, the Permalloy has a low specific resistance, and consequently, the iron loss thereof increases in a high frequency. On the other hand, the Ferrite has a low iron loss in a high frequency, but the magnetic flux density thereof is as low as 5000 Gauss at most, and consequently, the iron loss thereof increases close to a saturation point when used at a high operating magnetic flux density.

Recently miniaturization of sizes is desired for a power transformer used at a switching regulator and for a choke coil, a common mode choke coil and the like used at a transformer operated in a high frequency.

For the miniaturization, an increase of an operating magnetic flux density is vital and, in this regard, a decrease of an iron loss of the Ferrite becomes the key issue for the practical use thereof.

In these days, an amorphous magnetic alloy having no grain (crystalline particle) has attracted considerable attention as a candidate for dissolving the above mentioned problems, because the amorphous magnetic alloy possesses excellent soft magnetic characteristics such as a high magnetic permeability and a low coercive force and, in this regard, is sometimes utilized in actual use.

The amorphous magnetic alloy contains Iron (Fe), Cobalt (Co), Nickel (Ni) as basic components, and Phosphorus (P), Carbon (C), Boron (B), Silicon (Si), Aluminium (Al), Germanium (Ge) are supplementally added thereto as elements for achieving amorphous state (Metalloid). However, the amorphous magnetic alloy does not always shows a low iron loss in every frequency and low material cost.

For example, an Fe-based amorphous magnetic alloy is economical and exhibits a very low iron loss almost one-fourth as great as Silicon steel in a low frequency in the range of 50–60 Hz but, in a high frequency over the range of 10 KHz, the Fe-based amorphous magnetic alloy shows such a considerably high iron loss which can hardly be suitable for an equipment use such as a switching regulator used in a high frequency.

For improving this drawback, a fraction of the Fe of an Fe-based amorphous magnetic alloy is replaced by a non magnetic metal such as Niobium (Nb), Molybdenum (Mo) and Chromium (Cr) in order to lower a magneto-striction for decreasing an iron loss and for increasing a high magnetic permeability thereof. However, in case of a magnetic core formed by a resin mold, some compressive stresses are imposed on the magnetic core because of a curing shrinkage of the resin, so that the inferiority of magnetic characteristics becomes relatively remarkable as time passing. For this reason an Fe-based amorphous magnetic alloy has not reached at sufficient characteristics to suit to the practical use as a soft magnetic material in a high frequency.

On the other hand, a Co-based amorphous magnetic alloy is put into actual use as a magnetic parts of electric equipment such as a saturable reactor because of the low iron loss and the high squareness ratio of magnetic characteristics thereof in a high frequency. However, the material cost thereof is comparatively high. As stated above, an Fe-based amorphous alloy is an economical soft magnetic material but has a restriction in actual use thereof in a high frequency because of a relatively large magnetostriction and an inferiority to a Co-based amorphous alloy in aspect of an iron loss and a magnetic permeability.

Although a Co-based amorphous alloy has superior magnetic characteristics, the Co-based amorphous alloy has a disadvantage of the high material cost thereof.

SUMMARY OF THE INVENTION

An object of this invention is to eliminate or improve the defects or drawbacks encountered to the prior art and to provide an Fe-based soft magnetic alloy having a high saturation flux density and excellent soft magnetic characteristics in a high frequency. This and other objects can be achieved according to this invention by providing an Fe-based soft magnetic alloy essentially consisting of an Fe-based alloy, characterized in that the Fe-based alloy includes fine crystal grain having an average size of 300 Å or less, and each of the fine crystal grains is composed of a body-centered cubic phase at least partially including a super lattice.

Thus, the resulting alloy has been found that by limiting the average size of the crystal grains properly and by existing of a super lattice in the grains, the alloy can exhibit a excellent magnetic characteristics.

The above objects and features of the present invention will appear more fully hereinafter from a consideration of the following description taken in connection with the accompanying drawings and tables.

BRIEF DESCRIPTION OF THE DRAWINGS

In the accompanying drawings:

FIG. 5 is a block diagram of a convential switching power source having various kinds of choke coils.

DESCRIPTION OF THE PREFERRED EMBODIMENTS

Figure 1:
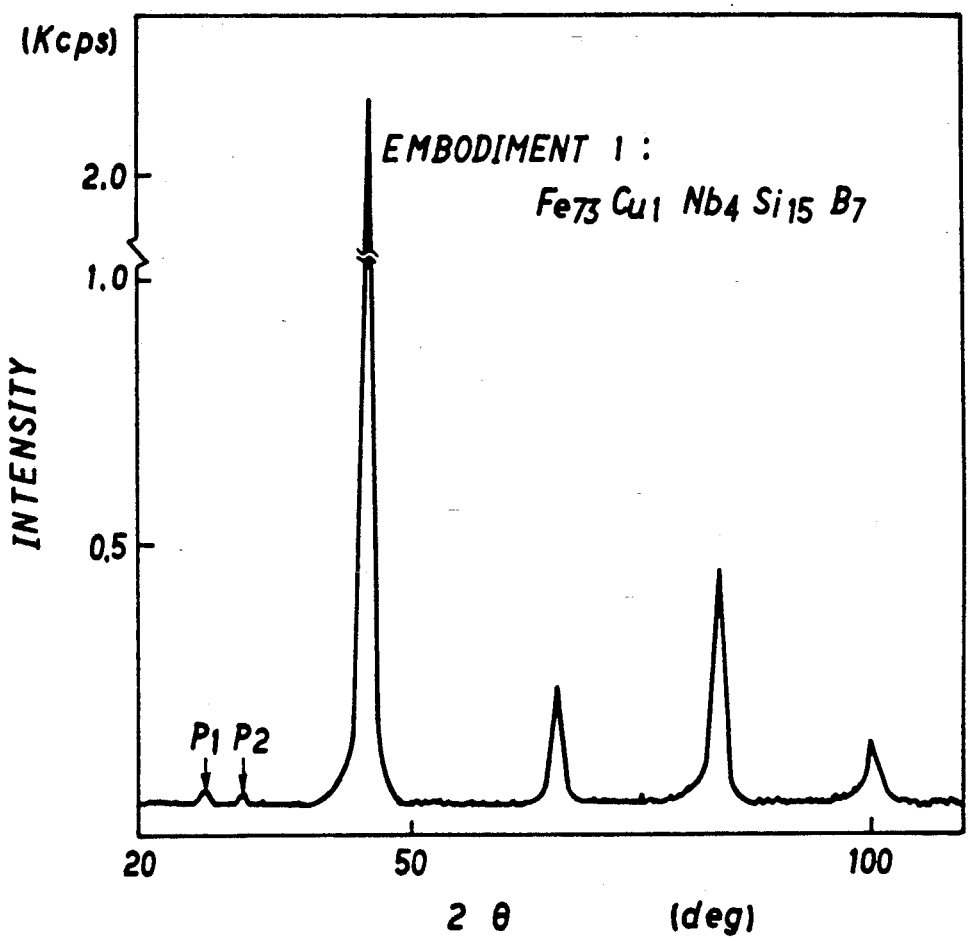
FIGS. 1(*a*) and 1(*b*) are graphs showing the x-ray diffraction pattern of the Fe-based soft magnetic alloy of this invention stated in EMBODIMENT 1 and an alloy stated in COMPARISON 1 mentioned hereunder, respectively.
Figure 1:
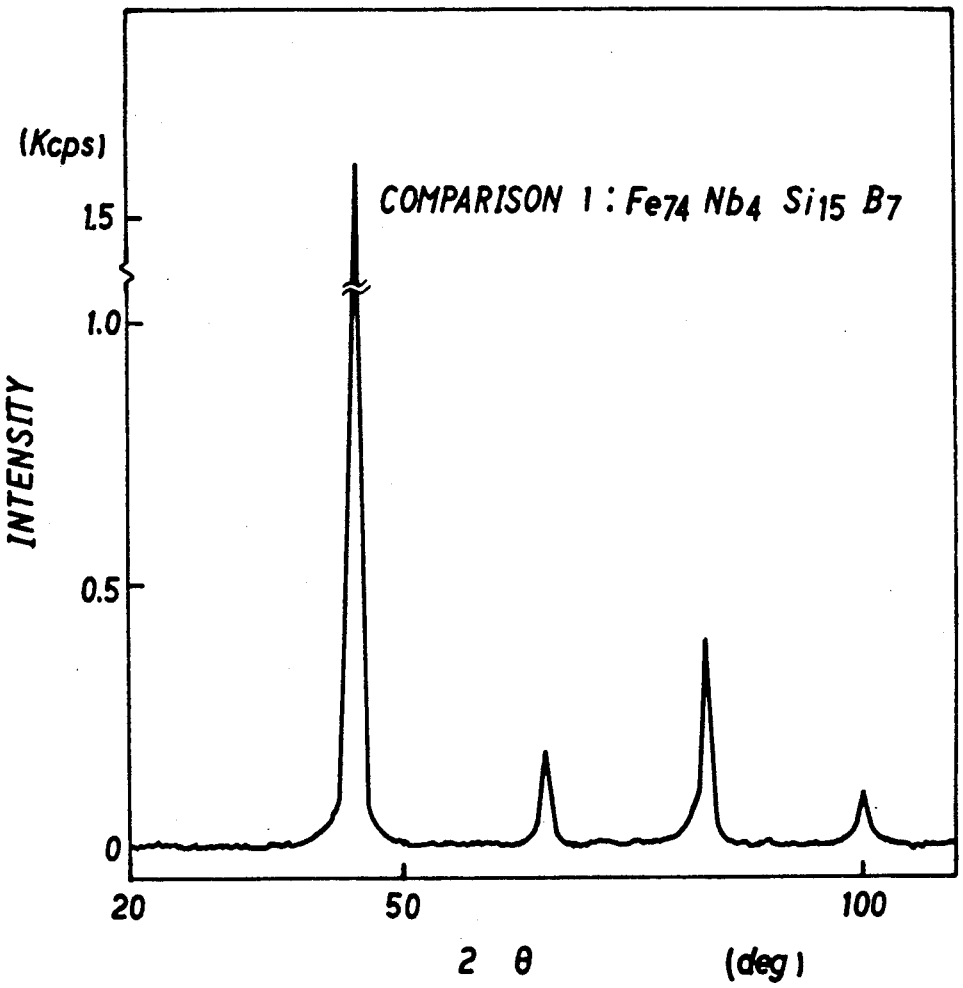

In order to achieve the aforesaid object, intensive investigation have been made by inventors on various kinds of alloys, and as the results of these investigations, an fe-based magnetic alloy with extremely fine grains having an average size of 300 Å or less is found to possess outstanding soft magnetic characteristics and is led to the present invention, in which the Fe-based magnetic alloy comprises a body-centered cubic phase containing a super lattice as the crystal structure thereof.

Each unit cell of a body-centered cubis phase (bcc phase) has a structure such that one atoms is positioned at each corner and at the central portion of the unit cell.

A preferable composition of the Fe-based magnetic alloy of the present invention has the composition represented by the general formula of $Fe_aCu_bM_cM'_dM_e''Si_fB_g$, wherein M is at least one element selected from the group consisting of IVa, Va and VIa and the rare-earth elements of the periodic table; M' is at least one element selected from the group consisting of Manganese (Mn), Aluminium (Al), Germanium (Ge) and elements of the Platinum group; M'' is Cobalt (Co) and/or Nickel (Ni); Fe, Cu, Si and B represent Iron, Copper, Silicon and Boron respectively.

Each coefficient a, b, c, d, e, f, g respectively satisfy the following formula:

$$a+b+c+d+e+f+g=100 \text{ (in atomic \%)}$$

$0.01 \leqq b \leqq 8$
$0.01 \leqq c \leqq 10$
$0 \leqq d \leqq 10$
$0 \leqq e \leqq 20$
$10 \leqq f \leqq 25$
$3 \leqq g \leqq 12$
$17 \leqq f+g \leqq 30$ Mentioned hereunder are the reasons for restricting the kinds of elements and the average fine grain sizes of this invention.

The explanation starts with the reasons for the element restriction.

Copper (Cu) is effective in order to enhance a corrosion resistance, to prevent the enlargement of grain sizes and to improve soft magnetic characteristics such as an iron loss and a magnetic permeability and is especially effective to prompt an early precipitation of a bcc phase at the comparably low temperature.

Addition of too little amount of Copper results in no effect on the reduction of core loss and, to the contrary, exceeding amount thereof causes deterioration of magnetic characteristics. In this regard, the content of Copper is restricted in the range of 0.01–8 atomic %, and the preferred content of Cu in the present invention is 0.1–5, atomic %, in which range the core loss is particularly small and the permeability is high.

M is effective not only to uniform grains sizes but also to improve the soft magnetic characteristics by reducing a magnetostriction and a magnetic anisotropy and is also effective in order to stabilize magnetic characteristics against temperature variations. M is especially effective for stabilizing a bcc phase and can stabilize the bcc phase against larger ranged temperature variations with a cooperative action of Copper.

Addition of too little amount of M results in no influence and, to the contrary, exceeding amount thereof causes no non-crystallization and a reduction of a saturation flux density.

In this regard, the content of M is restricted in the range of 0.01–10 atomic %, and the preferred range is 1–8 atomic %.

In addition to the above effects, each of "M" element selected from the group consisting of IVa, Va and VIa family elements of the periodic table has the following effects:

An element selected from the IVa group will spread heat treatment conditions for obtaining the most suitable magnetic characteristics;

An element selected from the Va group will be effective to improve toughness and machine workability such as cutting; and An element from the VIa group will improve wear resistance and roughness of a material surface.

Among the above mentioned elements, Tantalum (Ta), Niobium (Nb), Tungsten (W) and Molybdenum (Mo) have considerable effects for improving soft magnetic characteristics and Vaandium (V) has remarkable effects for increasing toughness and for improving surface roughness of a material, and the addition thereof are quite desirable.

M' is an effective element to improve soft magnetic characteristics. However, addition of excess amount of M' causes the decrease of a saturation flux density. In this connection, the maximum content of M' is restricted to maximum 10 atomic %.

Al, which is one of possible elements for M', is effective for generating fine grains, to improve magnetic characteristics and to stabilize a bcc phase. Ge is also effective for stabilizing a bcc phase, and an element selected from the Platinum group, which are another possible elements for M', will help to improve a corrosion resistance and a wear resistance respectively.

M'' is effective to improve a saturation flux density and successively is effective to improve a magnetostriction and soft magnetic characteristics. However, because of the fact that excess amount of M'' rather decreases a saturation flux density, the content thereof is maintained 20 atomic % or less.

Silicon (Si) and Boron (B) prompt non-crystallization of an alloy can raise a crystallization temperature and, in consequence, can improve a heat treatment condition for upgrading magnetic characteristics. Especially, Si forms solid solution in Fe, which is the main component of fine grains, and works to reduce a magnetostriction and a magnetic anisotropy. However, the effectiveness of Si for improving soft magnetic characteristics is not remarkable when the content of Si is 10 atomic % or less.

When is exceeds 25 atomic %, relatively large coarse grains of micro meters in diameter are precipitated due to a lack of an ultra rapid quenching effect.

Si in an essential element to compose a super lattice and the content thereof is controlled between in the range of 10–25 atomic % for generating a super lattice and is more preferably controlled in the range of 10–22 atomic %.

When the content of B is less than 3 atomic %, no sufficient effect on improving soft magnetic characteristics because of the precipitation of relatively coarse grains. On the other hand, when it exceeds 12 atomic %, B element easily precipitates in the course of a heat treatment and deteriorates soft magnetic characteristics.

The ratio of Si and B satisfying the equation $Si/B \geqq 1$ is desirable to obtain excellent soft magnetic characteristics.

Especially, by maintaining the amount of Si in the range of 14–20 atomic %, a magnetostriction $\lambda$ s comes down to almost zero, and a deterioration of magnetic characteristics by a resin mold is successfully prevented and, in addition, superior soft magnetic characteristics obtained just after a heat treatments can be maintained for a long term. In this case, the content of M more than 2 atomic % is preferably for actual use because a corrosion resistance is greatly improved.

An Fe-based soft magnetic alloy according to the present invention can be obtained by using an aimed fine grain precipitation method. At the aimed fine grain precipitation method, thin strips of an amorphous alloy manufactured by liquid quenching method or amorphous powders manufactured by applying an atomizing or a mechanical alloying method are heat treated for 10 minutes to 50 hours, preferably for 0.5 hour to 25 hours, at the temperature range (Tx − 50) to (Tx + 150)°C. preferably (Tx − 30) to (Tx + 120)°C. wherein Tx is a crystallization temperature of aforesaid amorphous alloy when it was measured at a heating rate of 10 deg/-min.

Hereunder fine grains of the Fe-based soft magnetic alloy are addressed.

At the Fe-based soft magnetic alloy according to this invention, quite few fine grains are not preferable because these fine grains yield a too much amorphous phase and cause a large magnetostriction and depletion of magnetic characteristics. On the other hand, soft magnetic characteristics decline when coarse grains with an average size of more than 300 Å thereof appear.

For these reasons, an average fine grains sizes are maintained 300 Å or less.

The remaining portion of the base alloy structure other than the fine crystal grains is may be amorphous.

Hereunder, the method of measuring an average size of fine grains are explained.

Generally, one crystal grain consists of number of crystallites. However, in the case of Fe-base alloy having a ultra-fine crystal structure according to this invention, one crystal grain is deemed as a single crystal, so that the size of the crystallite is substantially equal to grain size.

Generally, a size of the crystallite is measured by an X-ray diffraction method. In this method, as the size of the crystallite becomes, finer, a width of diffraction pattern varies wider. In this regard, corelation between the size (D) of the crystallite and the width (W) of the diffraction pattern is generally given by the following Scherrer's equation;

$$D = \frac{K \cdot \lambda}{\beta \cos \theta}$$

wherein λ is wave length of X-ray, θ is Bragg angle, K is proportional constant respectively.

An average fine grain size according to this invention, will be determined as arithmetic means of measurement obtained by measuring the same sample alloy more than 10 times.

An Fe-based soft magnetic alloy of this invention possesses superior soft magnetic characteristics in a high frequency and can be suitably used as a high frequency magnetic core material such as for a magnetic head, a thin film head, a high frequency transformer including high voltage use, a saturable reactor, a common mode choke coil, a normal mode choke coil, a high voltage pulse noise filter, a flat inductor, a dust core and a magnetic switch such as for a laser power source and also can be suitably sued as a magnetic material or various sensors such as a current sensor, a directional sensor, a security sensor and a torque sensor.

The present invention will be more clearly understood with reference to the following embodiments.

EMBODIMENT 1

An amorphous ribbon of an alloy having the composition of $Fe_{73}Cu_1Nb_4Si_{15}Br_7$, which is 5 mm in width and 14 μm in thickness, was obtained by a single role method, and a toroidal magnetic core of 12 mm in inner diameter and 18 mm in outer diameter was made by winding this thin ribbon.

COMPARISON 1

For a comparison purpose, a toroidal magnetic core having the composition of $Fe_{74}Nb_4Si_{15}B_7$ was produced by using the same method as used in the EMBODIMENT 1. Toroidal magnetic cores of the EMBODIMENT 1 and this COMPARISON 1 ware heat treated for 50 minutes at a temperature 30° C. above a crystallization temperature of each magnetic core at a heating rate of 10° C. per one minutes.

The magnetic cores of the EMBODIMENT 1 and this COMPARISON 1 were x-ray diffraction tested under the conditions that a target was Cu, voltage was 40 kV and electric current was 100 mA.

When x-rays with a specific wave length λ are projected on a surface of a metal which has ordered super lattices, these x-rays are reflected from atomic planes in crystals. In other words, according to a x-ray diffraction method, x-rays are selectively reflected to the specific directions so as to meet the following the Bragg's equation, wherein θ is an incidence angle, and d is a distance between atomic planes:

$$n\lambda = 2d \sin\theta (n = 1, 2, 3 \cdots)$$

Therefore, the existence of a super lattice can be confirmed by measuring the amount of reflected x-rays using a xray diffraction test. The results of this x-ray diffraction test are shown in FIGS. 1(*a*) and (*b*), wherein a reflecting rate of x-rays is indicated in count numbers per second (CPS).

In case of the alloy of the EMBODIMENT 1, deflected x-rays peculiar to a super lattice appear at the vicinity of $2\theta = 27$ degrees and 31 degrees, and peaks $P_1$ and $P_2$ are confirmed. To the contrary, in case of the alloy of the COMPARISON 1, no peak of reflected x-rays appears as shown in FIG. 1(*b*), and this fact explains no existence of a super lattice.

As the next step, an initial magnetic permeability μ' of 1 KHz (exciting magnetic fields Hm = 5 mOe) and a direct current coercive force Hc were measured with an impedance analyzer on the magnetic cores made of the aforesaid two alloys.

In additions, some tests pieces were sampled from each of these magnetic cores, and the surfaces thereof were observed through a transmission electron microscope (TEM), and grain sizes thereof were measured. The obtained data are shown in Table 1.

TABLE 1

| | EXISTENCE OF SUPER LATTICE | INITIAL MAGNETIC PERMEABILITY μ' 1 KHz | COERCIVE FORCE Hc(Oe) | CRYSTALLINE PARTICLE SIZE (Å) |
|---|---|---|---|---|
| EMBODIMENT 1 | OBSERVED | 148000 | 0.006 | 50-200 |
| COMPARISON 1 | NONE | 820 | 0.36 | 100-300 |

As apparent from the data obtained, an Fe-based soft magnetic alloy of the present invention possesses excellent magnetic characteristics such as a high magnetic permeability and a low coercive force.

EMBODIMENT 2 an amorphous ribbon of an alloy having the composition of $Fe_{73.5}Cu_{3.5}Nb_3Si_{14}B_6$, which is 10 mm in width and 16 μm in thickness, was prepared by a single inner method, and a toroidal magnetic core of 12 mm in inner diameter and 15 mm in outer diameter was formed by winding this thin ribbon.

The toroidal wound core was heat treated for 60 minutes at various temperatures and coercive forces thereof wee measured. The relationship between measured coercive forces (Hc) of the toroidal magnetic cores and heat treatment temperatures are shown in FIG. 2.

Figure 2:
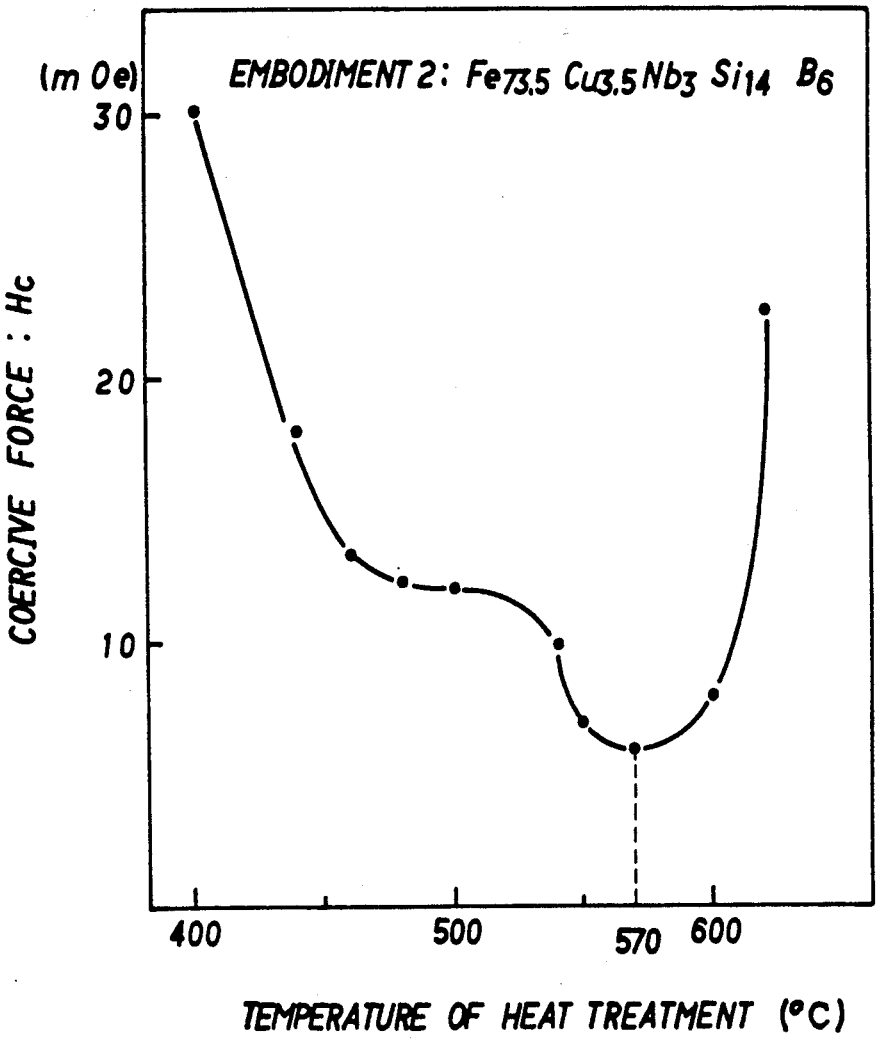
FIG. 2 is a graph showing a coercive force and temperature relationship of the fe-based soft magnetic alloy of this invention stated in EMBODIMENT 2.

As apparent from the FIG. 2, an alloy with a low coercive force can be obtained in the range of 500°-600° C.

Figure 3:
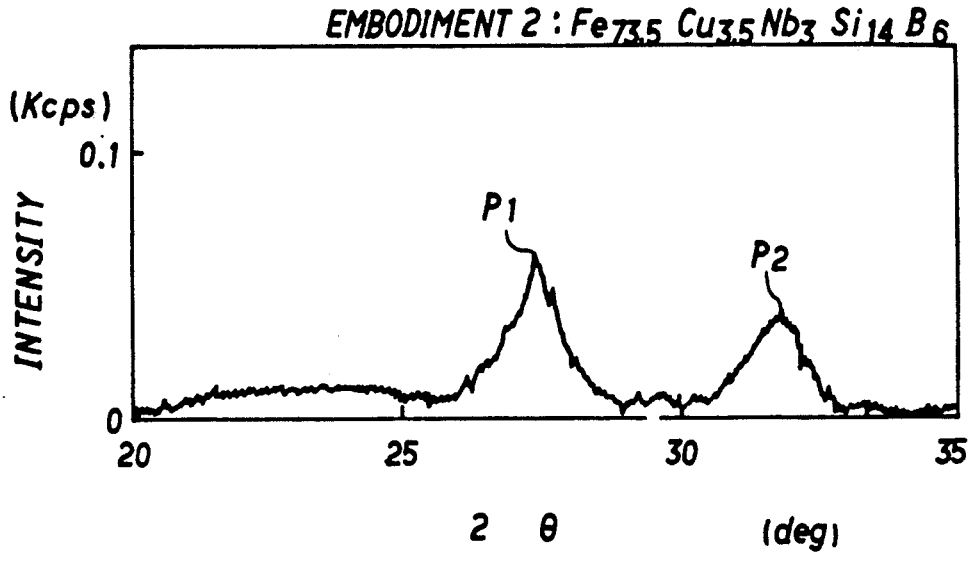
FIG. 3 is a graph showing the x-ray diffraction patterns of the fe-based soft magnetic alloy of this invention stated in EMBODIMENT 2.

The magnetic core heat treated at 570° C. received a x-ray diffraction test under the same conditions as the EMBODIMENT 1, and the test results are indicated in FIG. 3.

As apparent from FIG. 3, the alloy with a low coercive force has reflected x-rays particular to a super lattice, and peaks $P_1$ and $P_2$ were confirmed. The grain sizes thereof were measured by TEM, and confirmed to scatter between 100 and 200 Å.

EMBODIMENT 3

An amorphous ribbon of an alloy having the composition of $Fe_{73}Cu_1Nb_{2.5}Si_{17}B_{6.5}$ was prepared by a single role method same as in the EMBODIMENT 1, and a toroidal wound core of 12 mm in inner diameter, 15 mm in outer diameter and 5 mm in height was formed by winding this thin ribbon.

The toroidal magnetic cores ware heat treated for 50 minutes at various temperatures, and a coercive force (Hc) thereof was measured. The relationship between measured coercive forces of the toroidal magnetic core and heat treatment temperatures are shown in FIG. 4.

Figure 4:
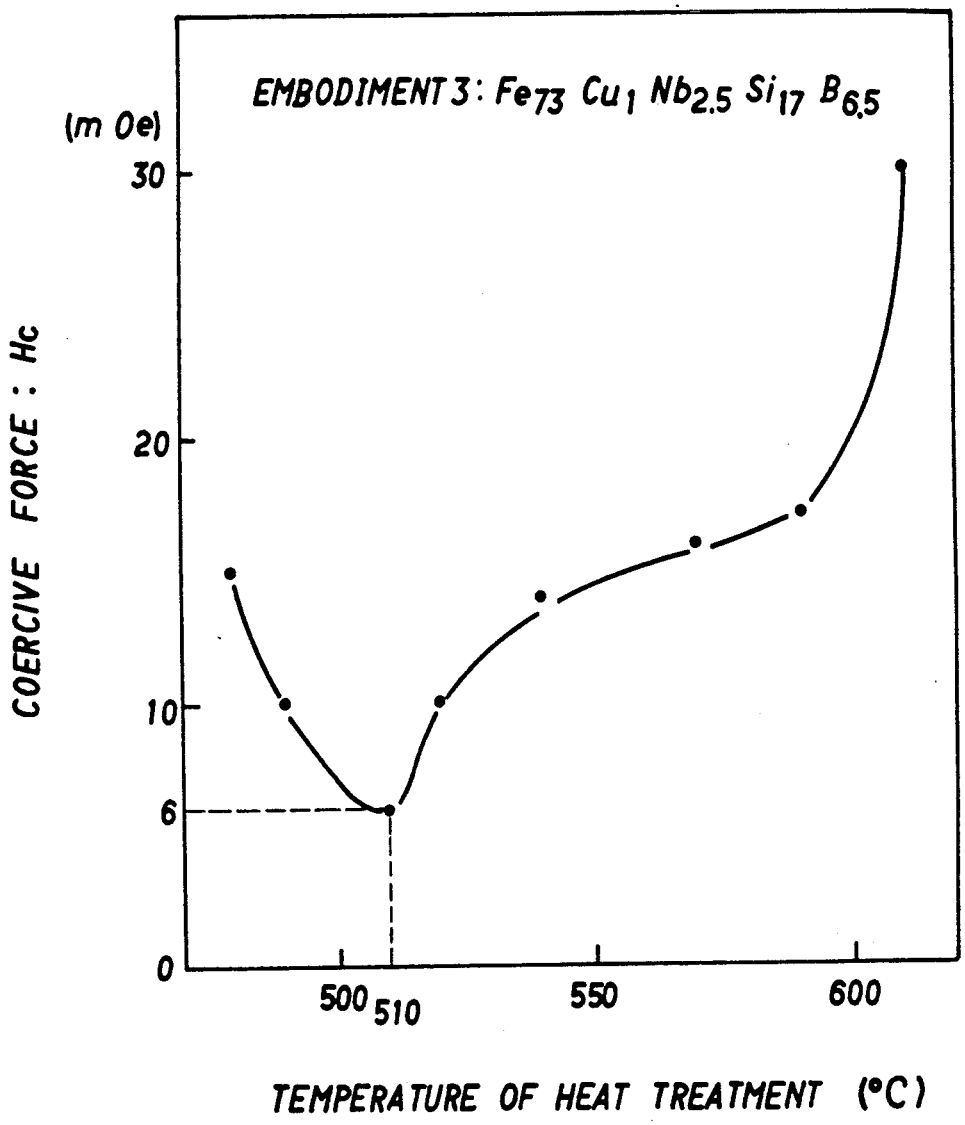
FIG. 4 is a graph showing a coercive force and temperature relationship of the fe-based soft magnetic alloy of this invention stated in EMBODIMENT 3.

As apparent form the FIG. 4, minimum 6 mOe was obtained at around 510° C.

A x-ray diffraction test on a magnetic core heat treated at around 510° C. among the above mentioned test samples was conducted under the same conditions as in the EMBODIMENT 1, and reflected x-rays particular to a super lattice were observed at small deflection angle side similar to FIG. 1 and FIG. 3. The grain sizes thereof were measured by TEM, and confirmed to scatter between 100 and 200 Å.

EMBODIMENT 4

Amorphous ribbons of various alloys listed in Table 2 were made in the same manner as in EMBODIMENT 1, and toroidal wound cores of 12 mm in inner diameter and 15 mm in outer diameter were made by winding these thin ribbons.

These toroidal wound cores were equally heat treated for 80 minutes at the same temperature, and an initial magnetic permeability of 1 KHz (exciting magnetic field Hm=5 mOe) and a d.c. current coercive force on the magnetic cores thereof were measured with an impedance analyzer as well as the confirmation of an existence of a super lattice by x-ray diffraction testes. The obtained data are shown in the same Table 2.

TABLE 2

| SAMPLE No. | COMPOSITION OF ALLOY | EXISTENCE OF SUPER LATTICE | COERSIVE FORCE Hc(mOe) | INITIAL MAGNETIC PERMEABILITY μ' 1 KHz × $10^4$ |
|---|---|---|---|---|
| 1 | $Fe_{73}Cu_{1.5}Mo_{2.5}Si_{16}B_7$ | OBSERVED | 6.5 | 13.8 |
| 2 | $Fe_{71.5}Cu_2W_{2.5}Si_{17}B_7$ | OBSERVED | 7.0 | 13.5 |
| 3 | $Fe_{71.5}Cu_{2.5}Ta_3Si_{15}B_8$ | OBSERVED | 7.0 | 13.3 |
| 4 | $Fe_{73}Cu_{1.5}Sm_2Si_{17}B_{6.5}$ | OBSERVED | 8.0 | 13.0 |
| 5 | $Fe_{73}Cu_{1.5}Nd_2Si_{17}B_{6.5}$ | OBSERVED | 8.0 | 13.0 |
| 6 | $Fe_{71.5}Cu_1Mo_3Ru_3Si_{14.5}B_7$ | OBSERVED | 5.5 | 14.7 |
| 7 | $Fe_{72}Cu_{1.5}W_3Cr_2Si_{15}B_{6.5}$ | OBSERVED | 6.0 | 13.9 |
| 8 | $Fe_{72}Cu_1Mo_3V_2Si_{15.5}B_{6.5}$ | OBSERVED | 6.0 | 14.5 |
| 9 | $Fe_{72}Cu_1Mo_3Mn_2Si_{15.5}B_{6.5}$ | OBSERVED | 6.0 | 14.2 |
| 10 | $Fe_{69}Co_4Cu_{1.5}Nb_3Si_{15}B_{7.5}$ | OBSERVED | 6.0 | 14.1 |
| 11 | $Fe_{69}Ni_4Cu_{1.5}Nb_3Si_{15}B_{7.5}$ | OBSERVED | 6.0 | 13.9 |
| 12 | $Fe_{79}Cu_1Nb_3Si_8B_9$ | NONE | 50 | 2.0 |
| 13 | $Fe_{77}Cu_1Nb_3Si_{10}B_9$ | NONE | 23 | 4.8 |
| 14 | $Fe_{74}Cu_1W_3Si_9B_{13}$ | NONE | 20 | 7.0 |

As apparent from Table 2, samples form the alloy of the present invention containing a super lattice (sample No. 1 through 11) exhibit superior magnetic characteristics to those of the samples not containing a super lattice (sample No. 12 through 14).

The grain sizes thereof were measured by TEM and confirmed to scatter between 100 and 200 Å.

EMBODIMENT 5

Powders of various alloys having composition listed in Table 3 were prepared by an atomizing method. These powders and round shapes and the average diameters thereof were ranged 10 to 50 μm.

These powders mixed with liquid glass, which worked as a binder, were formed into toroidal magnetic coils with the dimensions of 38 mm × 19 mm × 12.5 mm under pressure, and the sample No. 1 through 6 were heat treated at the temperature of 540° C. for 60 minutes before being served as test pieces.

For a comparison purpose, a toroidal magnetic core of sample No. 9 was made from iron dusts and was prepared in the same manner as the sample No. 1 through 6.

In addition, for a comparison purpose, an evaluation was conducted on a toroidal magnetic core of sample No. 7 made of $Fe_{71}Cu_1Mo_3Si_{13}B_{12}$ amorphous ribbon and No. 8 made of $Fe_{79}Si_{10}B_{11}$ which was formed into the same shape of the sample Nos. 1 to 6, heat treated, impregnated by resin and gap formed.

Measurements of an initial magnetic permeability $\mu'$ at 10 KHz and a Q value (at 100 KHz) representing a loss of magnetism were carried out on each magnetic core tabulated in Table 3.

TABLE 3

| SAMPLE No. | COMPOSITION OF ALLOY | INITIAL MAGNETIC PERMEABILITY $\mu'$ 1 KHz | Q VALUE 100 KHz |
|---|---|---|---|
| 1 | $Fe_{72}Cu_4Ta_3Si_{14}B_7$ | 160 | 50 |
| 2 | $Fe_{72}Cu_4W_3Wi_{14}B_7$ | 160 | 50 |
| 3 | $Fe_{72}Cu_4Mo_3Si_{14}B_7$ | 157 | 48 |
| 4 | $Fe_{72}Cu_4Nb_3Si_{14}B_7$ | 165 | 53 |
| 5 | $Fe_{72}Cu_4Nb_2Cr_2Si_{14}B_6$ | 165 | 52 |
| 6 | $Fe_{72}Cu_4Nb_2Ru_2Si_{14}B_6$ | 167 | 55 |
| 7 | $Fe_{71}Cu_1Mo_3Si_{13}B_{12}$ | 105 | 28 |
| 8 | $Fe_{79}Si_{10}B_{11}$ (CUT CORE) | 100 | 25 |
| 9 | IRON DUST | 30 | 11 |

thus, it has been clarified that all the magnetic cores of the present invention achieve a high magnetic permeability and a high Q value.

X-ray diffraction tests on magnetic cores, made of the same materials receiving the same heat treatments, under the same conditions as those of EMBODIMENT 1 confirmed the fact that reflected x-rays particular to a super lattice directed to a small deflection angle side. The average grain sizes thereof were measured by TEM and confirmed to spread between 100 and 200 Å.

FIG. 5 shows a block diagram of a conventional switching power source in which various kinds of choke coils such as a normal mode choke coil, a common mode choke coil and an output choke coil are provided in order to control a current flow.

In a case where the power source is for single-phase, three terminals are provided, i.e., two terminals are for each of the AC liens, one for the ground. During a switch operation, normal mode noise is liable to be generated between the two AC lines, while common mode noise is generated between either one of the AC liens and the ground. The normal choke coil and the common mode choke coil are used as inductors for the purpose of reducing the noises of switch operation.

Namely, the normal choke coils are usually formed of powder magnetic core, and are provided between the two AC lines in order to reduce the normal mode noise. By the way, the common mode choke coils for reducing a common mode noise are formed by winding two wires around on a toroidal magnetic core in reverse mode (anti-phase mode).

On the other hand, output choke coils are commonly formed of resin impregnated magnetic core, and they are commonly provided in a switching power source for the purpose of suppressing AC components, thereby to output a stabilized DC output.

The aforementioned respective choke coil is required to have excellent soft magnetic characteristics such as a high saturation flux density, a high magnetic permeability and a low iron loss. In this regard, the Fe-based soft magnetic alloy according to the present invention has all the desired characteristics, so it seems to be most suitable to utilize the outstanding present alloy as a core material.

EMBODIMENT 6 an amorphous thin ribbon of an alloy having the composition of $Fe_{73}Cu_1Nb_4Si_{15}B_7$, which is 5 mm in width and 14 μm in thickness, was prepared by utilizing a single roll method. A toroidal magnetic ore having an outer diameter of 18 mm and an inner diameter of 12 mm was formed by winding the thin ribbon, then the toroidal magnetic core was heat treated for 50 minutes at a temperature of 550° C. (which is 30° C. higher than the crystallization temperature of the core material). A wire was wound around on the core 20 times to form a common mode choke coil.

COMPARISON 2

For a comparative purpose, a toroidal magnetic core having a composition of $Fe_{74}Nb_4Si_{15}B_7$ was prepared by using the same method described in EMBODIMENT 6. The toroidal magnetic core was then heat treated for 50 minutes at a temperature of 610° C. (which is 30° C. higher than the crystallization temperature of the core material). In the same manner, a wire was wound around on the core 20 times to form a common mode choke coil.

COMPARISON 3

For a comparative purpose, a common mode choke coil having the same dimensions and wires as that of EMBODIMENT 6 was prepared by using a conventional Mn-Zn Ferrite as a core material.

Each of the thus prepared common mode choke coils 1 of EMBODIMENT 6 and COMPARISONS 2 AND 3 was provided respectively in a switching power source as shown in FIG. 5, and an effect of noise reduction was measured as a noise voltage at the time of the power source being operated at a switching frequency of 40 KHz, 80 KHz and 120 KHz, respectively.

COMPARISON 4

For a comparative purpose, a noise voltage was also measured in a case where common mode choke was not provided in the switching power source.

The measured values are shown in Table 4 listed hereunder.

TABLE 4

| SWITCHING FREQUENCY | NOISE VOLTAGE (dBμ v) 40 KHz | 80 KHz | 120 KHz |
|---|---|---|---|
| EMBODIMENT 6 | 60 | 53 | 37 |
| COMPARISON 2 | 75 | 72 | 61 |
| COMPARISON 3 | 70 | 69 | 54 |
| COMPARISON 4 | 77 | 78 | 65 |

As is clear from Table 4, is confirmed that the common mode choke coil of EMBODIMENT 6 is effective in reducing the noise of switch operation, in particular, at high frequency in comparison with the cases of COMPARISONS 2 and 3.

EMBODIMENT 7

An amorphous alloy powder having the composition of $Fe_{71}Cu_1Mo_3Si_{13}B_{12}$ was prepared by utilizing an atomizing method. The alloy powder containing a binder was hot-pressed for 60 minutes at a temperature of 540° C. to form a magnetic core having an outer diameter of 38 mm, an inner diameter of 19 mm and a height of 12.5 mm, then a normal mode choke coil was prepared by using the magnetic core.

COMPARISON 5

For a comparative purpose, a magnetic core was prepared by utilizing a conventional iron powder as a core material to form a dust core, and a normal mode choke coil having the same dimensions as that of EMBODIMENT 7 was prepared.

Each of the thus prepared normal mode choke coils 2 of EMBODIMENT 7 and COMPARISON 5 was provided respectively in the switching power source as shown in FIG. 5, and a colorific value generated from the choke coil at the time of switching operation was measured as a temperature rise.

As the result, the temperature rise of the normal choke coil of EMBODIMENT 7 was 5° C., while that of COMPARISON 5 was 20° C. Accordingly, it is confirmed that the normal choke coil according to the present invention is proven effective in reducing the noise of switch operation in comparison with the conventional choke coils.

EMBODIMENT 8

An amorphous alloy having the composition of $Fe_{78}Cu_1Nb_{2.5}Si_{17}B_{6.5}$ was prepared by utilizing a single roll method, and a toroidal magnetic core having an outer diameter of 15 mm and an inner diameter of 12 mm was formed. The toroidal magnetic core was heat-treated for 50 minutes at a temperature of 510° C., then the magnetic core was resin-impregnated and provided with a gap having a width of 0.2 mm to form a output choke coil.

COMPARISON 6

For a comparative purpose, an output choke coil was prepared by utilizing the same manner as expressed in EMBODIMENT 8 except that the heat treatment was conducted for 50 minutes at the temperature of 400° C.

Each of the thus prepared output choke coils 3 of EMBODIMENT 8 and COMPARISON 6 was provided respectively in the switching power source as shown in FIG. 5, and a temperature rise of the magnetic core was measured during the switching operation.

As the result, the temperature rise of the output choke coil 3 of EMBODIMENT 8 was 28° C., while that of COMPARISON 6 was 52° C. Accordingly, it is confirmed that each of the output choke coils 3 according to the present invention has a small iron loss.

As explained above, the present invention can offer an Fe-base soft magnetic alloy having excellent soft magnetic characteristics in a high frequency, as well as a high saturation flux density.

It is to be understood by those skilled in the art that the foregoing description is preferred embodiments of the disclosed invention and that various changes and modifications may be made in the invention without departing from the spirit and scope appended claims.

What is claimed is:

1. A toroidal choke coil comprising an Fe-based soft magnetic alloy essentially consisting of an Fe-based alloy, wherein said Fe-based alloy includes fine crystal grains having an average size of 300 Å or less and each of said fine crystal grains is composed of a body-centered cubic phase at least partially including a super lattice.

2. A choke coil according to claim 1, said Fe-based alloy having the composition represented by the general formula:

$$Fe_a Cu_b M_c M'_d M''_e Si_f B_g,$$

wherein M is at least one element selected form the group consisting of Ti, Zr, Hf, V, Nb, Ta, Cr, Mo, W, and the rare earth elements, M' is at least one element selected from the group consisting of Ti, Zr, Hf, V, Nb, Ta, Cr, Mo, W, and the rare earth elements, M' is at least one element selected from the group consisting of Mn, Al, Ge and the Platinum elements, and M'' is Co and/or Ni, wherein coefficients of a, b, c, d, e, f and g respectively satisfy $$a+b+c+d+e+f+g=100 \text{ (atomic \%)}$$

$0.01 \leqq b \leqq 8$,
$0.01 \leqq c \leqq 10$,
$0 \leqq d \leqq 10$,
$0 \leqq e \leqq 20$,
$10 \leqq f \leqq 25$,
$3 \leqq g \leqq 12$ and
$17 \leqq f+g \leqq 3$.

3. A choke coil according to claim 1, wherein said choke coil is a common mode choke coil.

4. A choke coil according to claim 1, wherein said choke coil is a normal mode choke coil.

5. A toroidal choke coil comprising an Fe-based soft magnetic alloy essentially consisting of an Fe-based alloy, wherein said Fe-based alloy includes fine crystal grains having an average size of 300 Å or less and each of said fine crystal grains is composed of a body-centered cubic phase at least partially including a super lattice, wherein said toroidal choke coil is composed of a resin-impregnated magnetic core.

6. A toroidal choke coil comprising an Fe-based soft magnetic alloy essentially consisting of an Fe-based alloy, wherein said Fe-based alloy includes fine crystal grains having an average size of 300 Å or less and each of said fine crystal grains is composed of a body-centered cubic phase at least partially including a super lattice, wherein said toroidal choke coil is formed as a dust core.

* * * * *